US007051407B2

(12) United States Patent
Hsu

(10) Patent No.: US 7,051,407 B2
(45) Date of Patent: May 30, 2006

(54) BRASSIERE STRAP CLASP

(76) Inventor: Yu-Li Hsu, No. 10-1, Shanshidong 5 St., Taichung (TW)

( * ) Notice: Subject to any disclaimer, the term of this patent is extended or adjusted under 35 U.S.C. 154(b) by 107 days.

(21) Appl. No.: 10/956,099

(22) Filed: Oct. 4, 2004

(65) Prior Publication Data

US 2006/0070214 A1 Apr. 6, 2006

(51) Int. Cl.
*A44B 11/12* (2006.01)

(52) U.S. Cl. ..... 24/170; 24/265 H; 24/318; 24/298; 2/336; 2/323; 450/86

(58) Field of Classification Search ..... 24/170, 24/265 H, 265 EC, 265 BC, 318, 346, 316, 24/192, 323, 298, 299; 450/86; 2/323, 336; D11/210

See application file for complete search history.

(56) References Cited

U.S. PATENT DOCUMENTS

| | | | | | |
|---|---|---|---|---|---|
| 1,769,753 | A * | 7/1930 | Reuter | 24/198 |
| 4,038,726 | A * | 8/1977 | Takabayashi | 24/198 |
| 5,177,837 | A * | 1/1993 | Rekuc | 24/198 |
| D491,101 | S * | 6/2004 | Hsu | D11/210 |
| 2005/0160564 | A1* | 7/2005 | Hsu | 24/318 |

* cited by examiner

*Primary Examiner*—Robert J. Sandy
(74) *Attorney, Agent, or Firm*—Fei-Fei Chao; Bingham McCutchen LLP

(57) ABSTRACT

A brassiere strap clasp is used to hold either a cloth strap or a bead strap. The brassiere strap clasp has a body and a clamp. The clamp is pivotally attached to the body and has multiple teeth that extend toward the body. The cloth straps and the bead straps can pass through the brassiere strap clasp and are held by the teeth on the clamp. Also, the brassiere strap clasp can be used to adjust the length of the strap.

9 Claims, 4 Drawing Sheets

BRASSIERE STRAP CLASP

BACKGROUND OF THE INVENTION

1. Field of Invention

The present invention relates to a brassiere strap clasp, and more particularly to a brassiere strap clasp that can hold several kinds of straps.

2. Description of the Related Art

A conventional brassiere strap clasp attaches to one kind of strap, such as a cloth strap or a bead strap, but cannot be attached to different kinds of straps including cloth straps and bead straps. The conventional brassiere strap clasp also needs a clamp to adjust the length of the brassiere strap. However, the clasp is often visible with dresses or blouses with low necklines or backs, which makes the appearance unsightly.

The present invention provides a brassiere strap clasp to mitigate or obviate the aforementioned problems.

SUMMARY OF THE INVENTION

The primary objective of the present invention is to provide a brassiere strap clasp that can be used with cloth straps and bead straps.

To achieve the objective, the brassiere strap clasp in accordance with the present invention has a body and a clamp. The clamp pivotally attaches to the body, forms a central slot between the clamp and the body and has multiple teeth that selectively extend into the central slot. The cloth straps and the bead straps pass through the central slot and are held by the teeth of the clamp. Also, the brassiere strap clasp can adjust the length of the strap.

Other objectives, advantages and novel features of the invention will become more apparent from the following detailed description when taken in conjunction with the accompanying drawings.

DETAILED DESCRIPTION OF THE INVENTION

Figure 1:
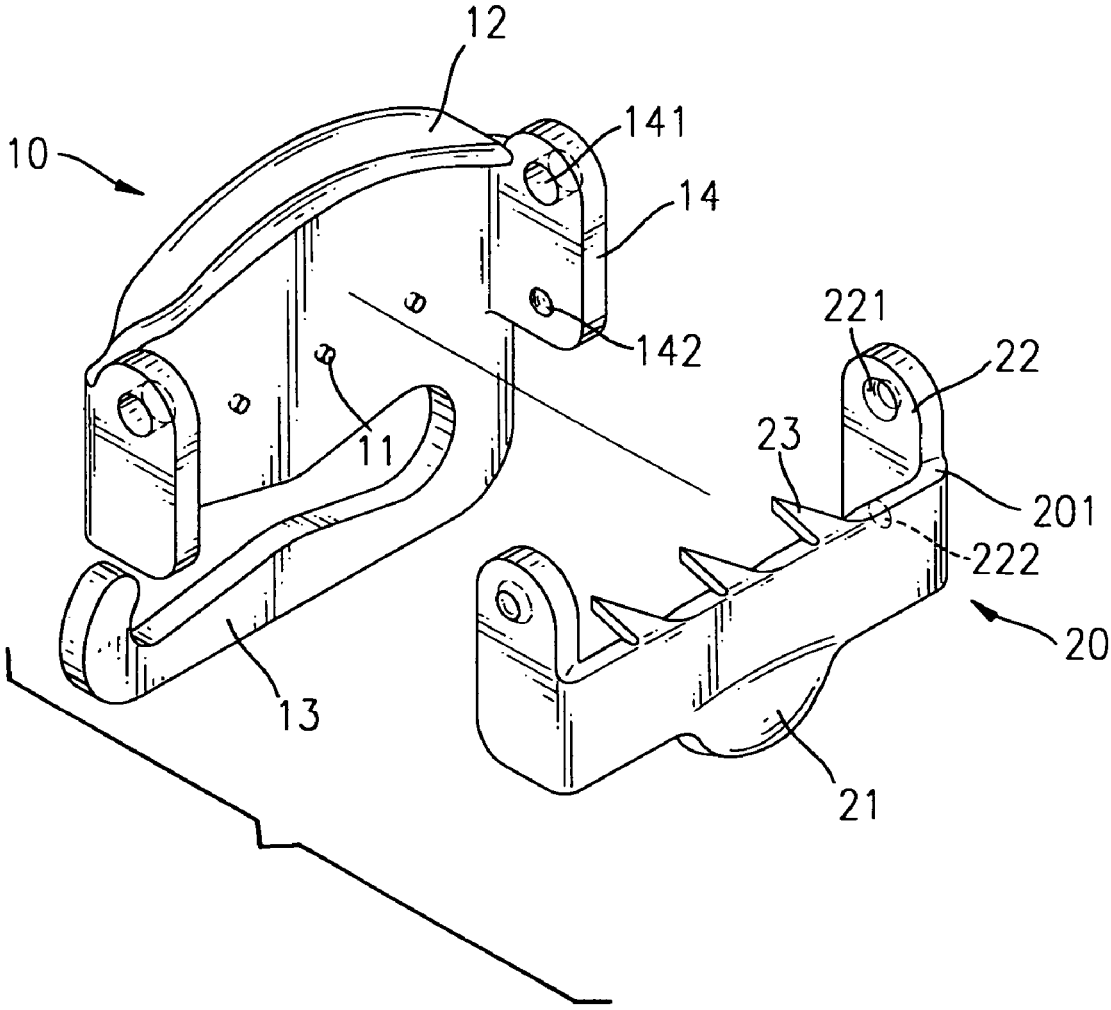
FIG. 1 is an exploded perspective view of a brassiere strap clasp in accordance with the present invention.
Figure 2:
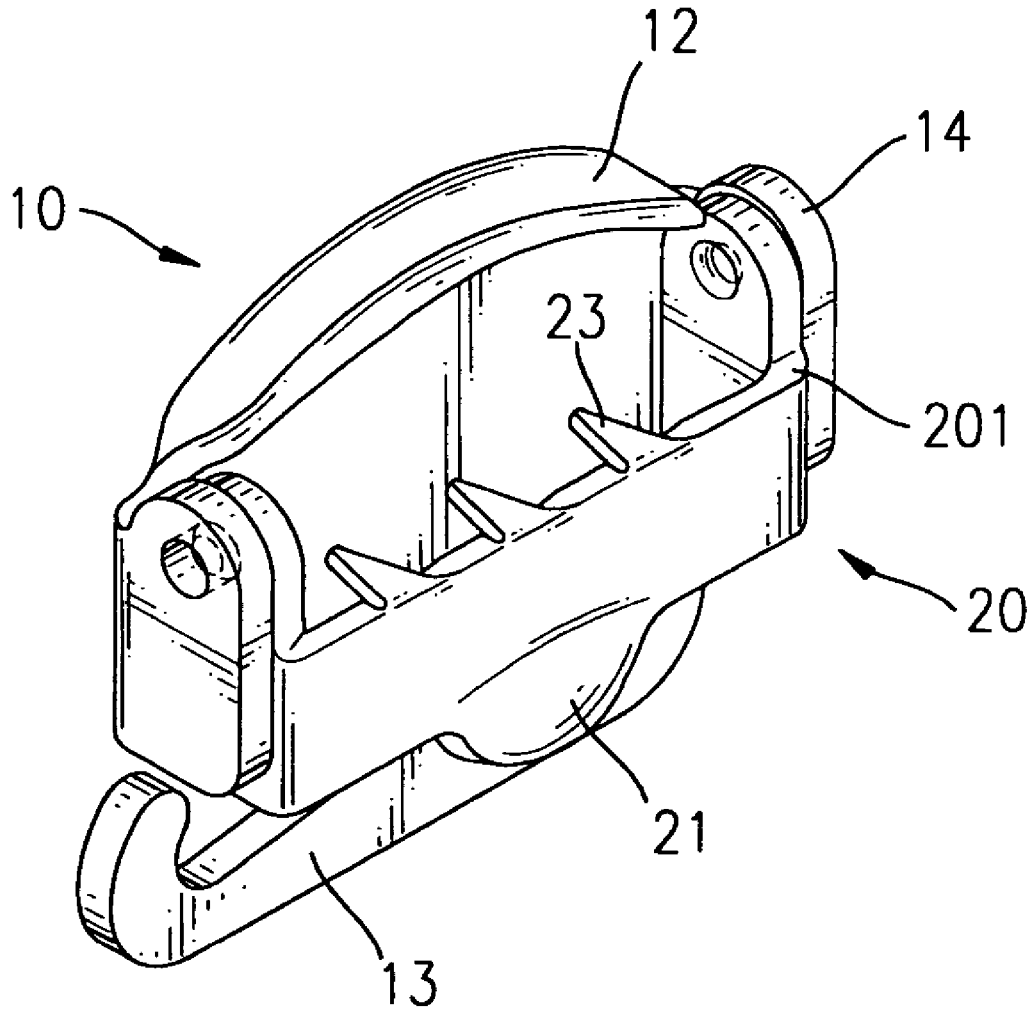
FIG. 2 is a perspective view of the brassiere strap clasp in FIG. 1.

With reference to FIGS. 1 and 2, a brassiere strap clasp in accordance with the present invention has a body (10) and a clamp (20) pivotally attached to the body (10).

The body (10) has a top edge, a bottom edge, two side edges, an inner surface, multiple optional holding recesses (11), an optional lip (12), a hook (13) and two wings (14). The holding recesses (11) are respectively defined in the inner surface of the body (10) and are aligned transversely. In a preferred embodiment, the inner surface of the body (10) has three holding recesses (11). The lip (12) is formed transversely with the top edge of the body (10), and the hook (13) is formed integrally with the bottom edge of the body (10) in the same plane. The wings (14) are integrally formed respectively with the side edges of the body (10), and each wing (14) has an inner surface and a pivot element. One of the wings (14) has an optional detent (142) defined in the inner surface of the wing (14). The pivot elements in the wings (14) are formed respectively in the inner surfaces of the wings (14) at a distance from the inner surface of the body (10) and may be holes (141) or recesses formed in the inner surface.

The clamp (20) is pivotally attached to the body (10) and has a top edge (201), a bottom edge, two side edges, an opening tab (21), two wings (22) and multiple teeth (23). The opening tab (21) is formed integrally on the bottom edge of the clamp (20) and extends away from the body (10). The wings (22) are flush respectively with the side edges of the clamp (20), and each wing (22) has an outer surface and a pivot element. The outer surfaces and the pivot elements correspond respectively to the inner surfaces and pivot elements of the wings (14) on the body (10). The pivot elements are formed a distance from the top edge (201). In a preferred embodiment, the distance of the pivot elements from the top edge (201) is greater than the distance of the pivot elements of the body (10) to the inner surface of the body (10). One of the wings (22) has an optional nub (222) formed on the outer surface to be selectively mounted in the detent (142) in the wing (14) of the body (10). In a preferred embodiment, the pivot elements of the wings (22) of the clamp (20) are posts (221) that are pivotally mounted respectively in the holes (141) or recesses in the wings (14) of the body (10). The multiple teeth (23) are formed on the top edge (201) of the clamp (20) and extend toward the inner surface of the body (10). In a preferred embodiment, three teeth are formed on the top edge (201) of the clamp (20) and insert into the holding recesses (11) in the body (10).

Figure 3:
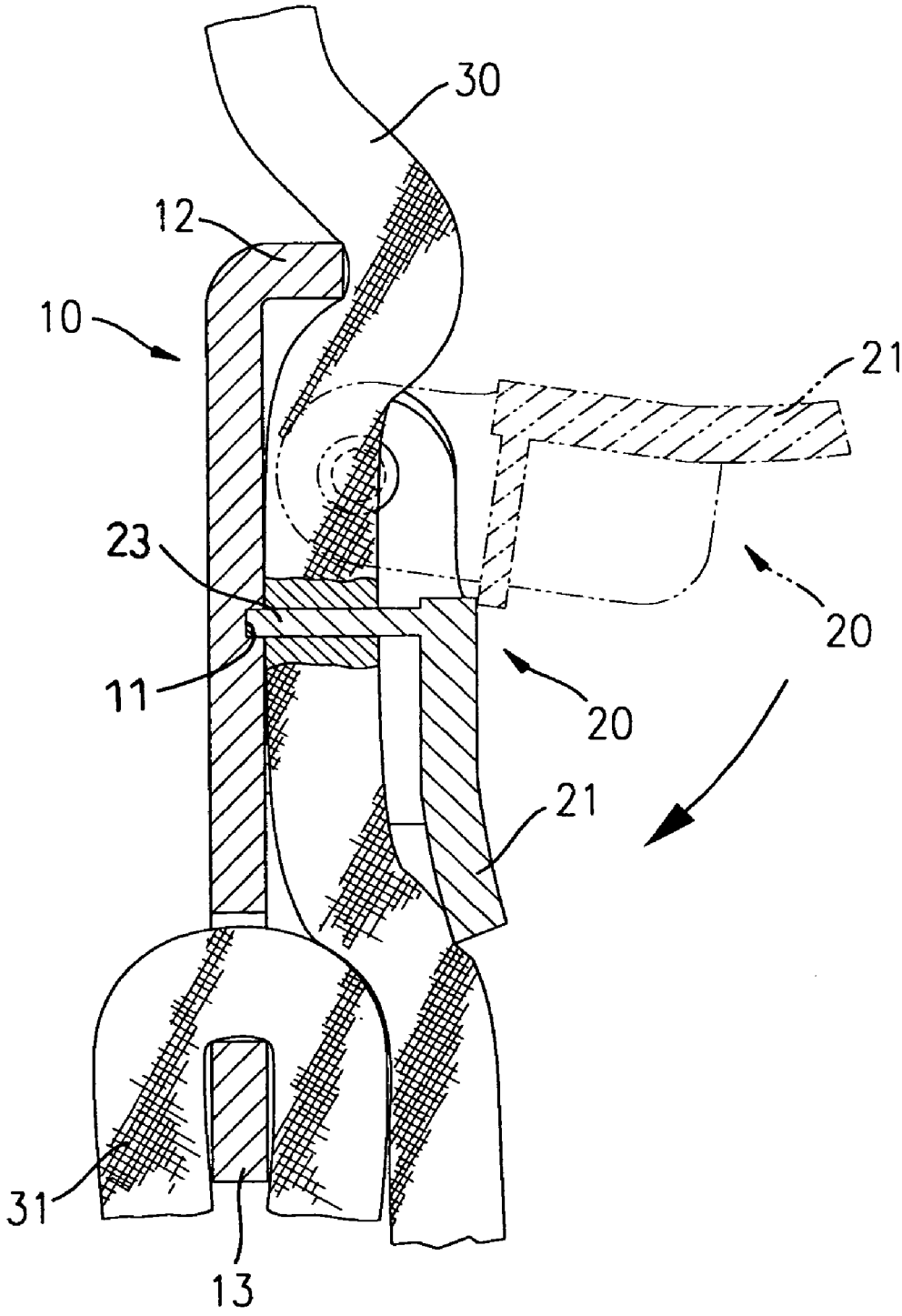
FIG. 3 is a side view in partial section of the brassiere strap clasp in FIG. 1 used with a cloth strap.
Figure 4:
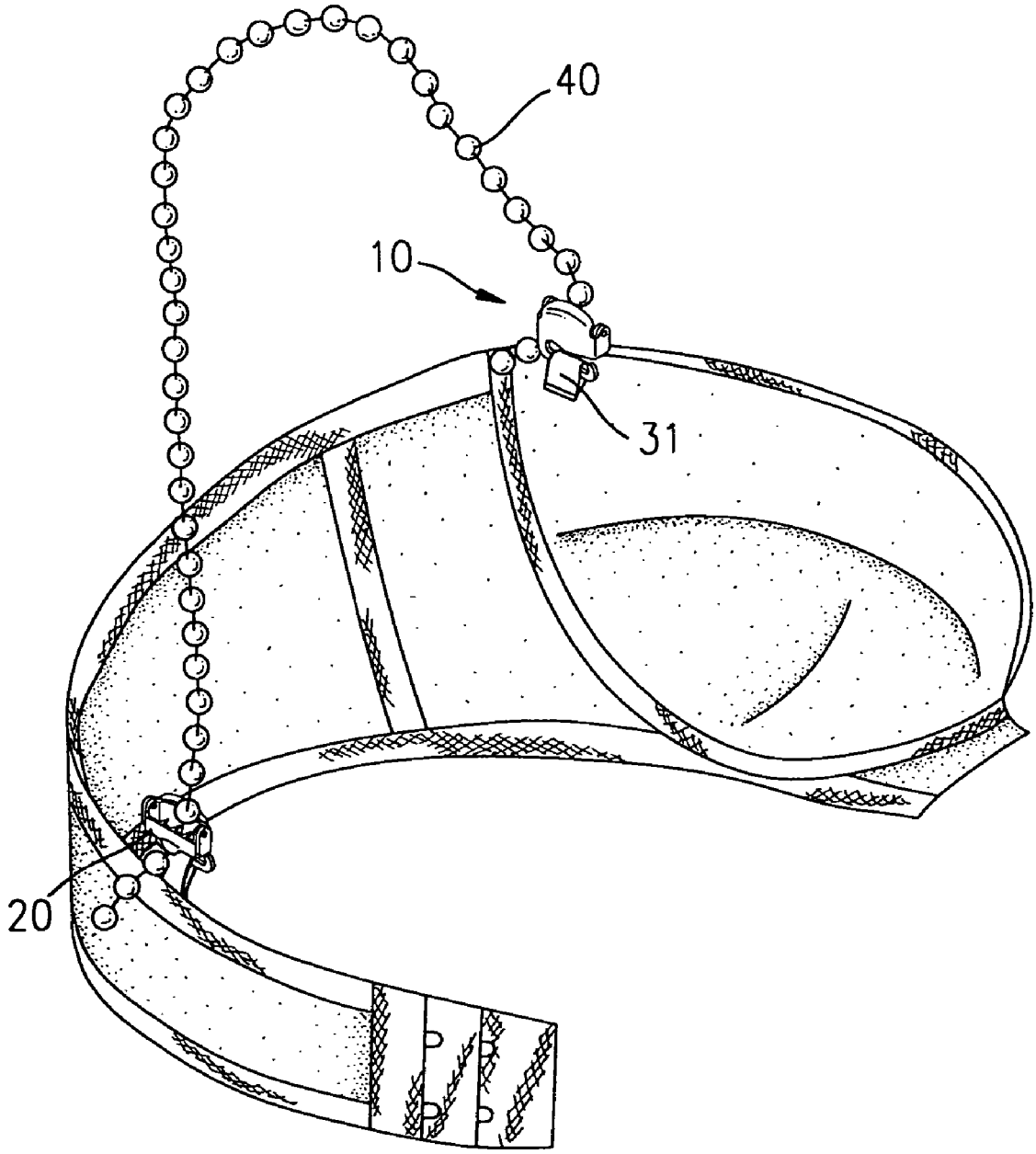
FIG. 4 is a perspective view in partial section of the brassiere strap clasp in FIG. 1 used with a bead strap.

With reference to FIGS. 3 and 4, the brassiere strap clasp is used by inserting the hook (13) of the body (10) into a transversely elongated eye (31) on a brassiere. When a cloth strap (30) is passed through the brassiere strap clasp and the clamp (20) is closed, the teeth (23) puncture and hold the cloth strap (30).

When a bead strap (40) is used, adjacent teeth (23) close around a string between two beads of the bead strap (40) to hold the bead strap (40) in the brassiere strap clasp.

Because the distance between the pivot elements on the clamp (20) and the top edge (201) of the clamp (20) is greater than the distance between the pivot elements on the body (10) and inner surface of the body (10), the space between the inner surface of the body (10) and the clamp (20) is large allowing the strap (30,40) to be adjusted easily when the clamp (20) is opened.

The brassiere strap clasp has the following advantages.

1. Different types of straps can be used with a dress without changing the underwear. The brassiere strap clasp in accordance with the present invention can also be used with a cloth strap and a bead strap.

2. The brassiere strap clasp in accordance with the present invention is used, the brassiere strap clasp does not need a separate clasp to adjust the length of the brassiere straps and does not distract from the appearance of beautiful clothes.

The invention may be varied in many ways by a person skilled in the art. Such variations are not to be regarded as a departure from the spirit and scope of the invention, and all such modifications are intended to be included within the scope of the following claims.

What is claimed is:

1. A brassiere strap clasp having a body having a top edge, a bottom edge, two side edges, an inner surface, a hook formed integrally with the bottom edge of the body in the same plane, and two wings integrally formed respectively with the side edges of the body, and each wing having an inner surface, and a pivot element defined in the inner surface of the wing and having a distance from the inner surface of the body, and a clamp pivotally attached to the body and having a top edge, a bottom edge, two side edges, an opening tab integrally formed on the bottom edge of the clamp and extending away from the body, two wings being flush respectively with the side edges of the clamp, and each wing having an outer surface facing to the inner surface of one of the wings on the body, and a pivot element formed on the outer surface of the clamp, having a distance from the top edge and corresponding to the pivot element on a corresponding wing on the body, and multiple teeth formed on the top edge of the clamp and extending toward the inner surface of the body.

2. The brassiere strap clasp as claimed in claim 1, wherein the pivot element of each wing of the body is a hole, and the pivot element on each wing of the clamp is a post, wherein each post is pivotally mounted inside one of the holes.

3. The brassiere strap clasp as claimed in claim 2, wherein the body further comprises a lip transversely formed on the top edge of the body.

4. The brassiere strap clasp as claimed in claim 3, wherein one of the wings of the body further comprises a detent defined in the inner surface of the wing, and one of the wings of the clamp further comprises a nub formed on the outer surface and received inside the detent in the wing.

5. The brassiere strap clasp as claimed in claim 4, wherein the body further comprises three holding recesses are defined in the inner surface and the three teeth are inserted into the holding recesses in the body.

6. The brassiere strap clasp as claimed in claim 1, wherein the body further comprises a lip transversely formed on the top edge of the body.

7. The brassiere strap clasp as claimed in claim 1, wherein one of the wings of the body further comprises a detent defined in the inner surface of the wing, and one of the wing of the clamp further comprises a nub formed on the outer surface and selectively held in the detent.

8. The brassiere strap clasp as claimed in claim 1, wherein the body further comprises three holding recesses are defined in the inner surface and the three teeth are inserted into the holding recesses in the body.

9. The brassiere strap clasp as claimed in claim 1, wherein the distance between the pivot element on the clamp and the top edge of the clamp is greater than the distance between the pivot element on the body and the inner surface of the body.

* * * * *